US010150209B2

(12) United States Patent
Matsuda et al.

(10) Patent No.: US 10,150,209 B2
(45) Date of Patent: Dec. 11, 2018

(54) HYDRAULIC HAMMERING DEVICE

(71) Applicant: Furukawa Rock Drill Co., Ltd., Chuo-ku, Tokyo (JP)

(72) Inventors: Toshio Matsuda, Takasaki (JP); Tsutomu Kaneko, Takasaki (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 368 days.

(21) Appl. No.: 15/113,645

(22) PCT Filed: Jan. 30, 2015

(86) PCT No.: PCT/JP2015/000408

§ 371 (c)(1),
(2) Date: Jul. 22, 2016

(87) PCT Pub. No.: WO2015/115105

PCT Pub. Date: Aug. 6, 2015

(65) Prior Publication Data

US 2017/0001293 A1 Jan. 5, 2017

(30) Foreign Application Priority Data

Jan. 30, 2014 (JP) ..... 2014-016092

(51) Int. Cl.
*B25D 9/14* (2006.01)
*B25D 9/18* (2006.01)
(Continued)

(52) U.S. Cl.
CPC ..... *B25D 9/145* (2013.01); *B25D 9/18* (2013.01); *B25D 9/20* (2013.01); *B25D 9/26* (2013.01);
(Continued)

(58) Field of Classification Search
CPC ..... B25D 2250/231; B25D 17/06; B25D 2209/005; B25D 2217/0019; B25D 9/145; B25D 9/18; B25D 9/20; B25D 9/04
(Continued)

(56) References Cited

U.S. PATENT DOCUMENTS 4,006,665 A * 2/1977 Klemm ..... B06B 1/183 91/278
4,022,108 A * 5/1977 Juvonen ..... B25D 9/12 91/276
(Continued)

FOREIGN PATENT DOCUMENTS

DE 301814 A7 3/1994
EP 0 335 994 A1 10/1989
(Continued)

OTHER PUBLICATIONS

Extended European Search Report in corresponding EP Application No. EP 15743549 dated Apr. 6, 2017, 10 pp.
(Continued)

*Primary Examiner* — Robert Long
(74) *Attorney, Agent, or Firm* — Young Basile Hanlon & MacFarlane, P.C.

(57) ABSTRACT

Provided is a hydraulic hammering device having improved hammering efficiency and of low cost. A piston has a valve switching groove between large-diameter sections thereof. A cylinder has three control ports at positions corresponding to the valve switching groove. A switching valve mechanism has a valve presser for always pressing a valve in one direction and also has a valve controller for moving, when supplying pressurized oil, the valve in the opposite direction against the pressing force of the valve presser. A valve control port communicates with the valve controller so as to supply the pressurized oil to the valve controller and is separated from a piston front chamber and a piston rear
(Continued)

chamber. Only either a piston retraction control port or a piston advance control port communicates with the valve control port depending on advance or retraction of the valve switching groove.

20 Claims, 6 Drawing Sheets

(51) Int. Cl.
*B25D 9/20* (2006.01)
*B25D 9/26* (2006.01)

(52) U.S. Cl.
CPC .. *B25D 2209/007* (2013.01); *B25D 2250/125* (2013.01)

(58) Field of Classification Search
USPC ..... 173/1–2, 13–17, 100–115, 124–129, 173/131–138, 141, 170, 184, 189, 193, 173/200–201, 204, 207, 218
See application file for complete search history.

(56) References Cited

U.S. PATENT DOCUMENTS 4,203,350 A 5/1980 Wallace
4,466,493 A 8/1984 Wohlwend
4,646,854 A * 3/1987 Arndt ..... B25D 9/145 173/207
4,852,664 A * 8/1989 Terada ..... B25D 9/12 173/206
4,996,783 A 3/1991 Fresia
5,293,747 A * 3/1994 Geiger ..... B25F 5/001 60/493
5,392,865 A * 2/1995 Piras ..... B25D 9/145 173/137
2005/0019123 A1* 1/2005 Lawson ..... B23B 31/08 409/140
2005/0167131 A1* 8/2005 Hurskainen ..... B25D 9/145 173/206
2009/0223691 A1* 9/2009 Ikuta ..... B25D 17/24 173/117
2009/0301744 A1* 12/2009 Swinford ..... E21B 4/14 173/200
2010/0193212 A1* 8/2010 Konecnik ..... B25D 9/04 173/218
2012/0018657 A1* 1/2012 Keskiniva ..... B25D 9/22 251/314
2012/0138328 A1* 6/2012 Teipel ..... B25D 9/12 173/207
2014/0262406 A1* 9/2014 Moore ..... B25D 9/145 173/208
2015/0336256 A1* 11/2015 Moore ..... B25D 9/12 173/1

FOREIGN PATENT DOCUMENTS

EP 739691 A1 10/1996
GB 1 340 017 12/1973
JP S46-001590 A 9/1971
JP S61-159386 A 7/1986
JP H02-298476 A 12/1990
WO 9954094 A1 10/1999

OTHER PUBLICATIONS

English translation of International Preliminary Report on Patentability in PCT/JP2015/000408 dated Aug. 11, 2016.

* cited by examiner

IMPACT POINT
200
110 201 113 114 205 112 202 111
120
121
123 308
124
125
126
300
309
306 134
135
137
310
210
307
400
130
401
102
101

HYDRAULIC HAMMERING DEVICE

TECHNICAL FIELD

The present invention relates to a hydraulic hammering device, such as a rock drill and a breaker, and, in particular, to a hydraulic hammering device that controls hydraulic pressurized oil so as to switch each of a front chamber and a rear chamber of a piston into communication with either a high pressure circuit or a low pressure circuit in an interchanging manner.

BACKGROUND

As a measure to obtain high output power, that is, strong striking force, from a hydraulic hammering device, attempts to increase the number of strikes have been carried out. To achieve a high number of strikes, a hammering method that controls hydraulic pressurized oil so as to switch each of a front chamber and a rear chamber of a piston into communication with either a high pressure circuit or a low pressure circuit in an interchanging manner (hereinafter, also referred to as "piston front/rear chamber high/low pressure switching type") is effective. That is, a hydraulic hammering device of the piston front/rear chamber high/low pressure switching type does not cause hydraulic oil on the front chamber side to resist movements of the piston in the striking direction. Thus, a hydraulic hammering device of the piston front/rear chamber high/low pressure switching type is suitable for achieving a high number of strikes.

As a hydraulic hammering device of this type, for example, a technology described in JP 46-001590 A has been disclosed. As illustrated in a schematic view in FIG. 9, a hammering device of the piston front/rear chamber high/low pressure switching type described in PTL 1 includes a piston 520 that has large-diameter sections 521 and 522, which are disposed in the axially middle portion thereof, and small-diameter sections 523 and 524, which are formed in front and the rear of the large-diameter sections, respectively. The piston 520 being disposed in such a way as to be slidably fitted into the inside of a cylinder 500 causes a piston front chamber 501 and a piston rear chamber 502 to be defined inside the cylinder 500 individually. In the middle between the piston large-diameter sections 521 and 522, an oil discharge groove 525 is formed. A description will be made herein by defining a hammering direction (the left direction in the drawings) as "front".

To the piston front chamber 501, a piston front chamber passage 506 is connected that communicates the piston front chamber 501 with either a high pressure circuit 538 or a low pressure circuit 539 depending on switching of a valve 526, which will be described later, between an advance and a retraction. On the other hand, to the piston rear chamber 502, a piston rear chamber passage 507 is connected that communicates the piston rear chamber 502 with either the high pressure circuit 538 or the low pressure circuit 539 depending on switching of the valve 526 between an advance and a retraction. The high pressure circuit 538 and the low pressure circuit 539 are provided with a high pressure accumulator 540 and a low pressure accumulator 543, respectively.

In the rear of the piston front chamber 501, a piston advance control port 503 is formed separated from the piston front chamber 501 at a predetermined interval, and, in front of the piston rear chamber 502, a piston retraction control port 504 is formed separated from the piston rear chamber 502 at a predetermined interval. The piston advance control port 503 has opening sections, which are intended for movements with a normal stroke and a short stroke, at two positions, and a piston advance control port 503*a* located on the piston front chamber 501 side is provided with a variable choke and is intended for a short stroke movement. A description will be made herein under an assumption that the piston advance control ports 503 and 503*a* are set to the normal stroke, that is, the variable choke is set to a full close state, and the piston advance control port 503 on the piston rear chamber 502 side works.

In the rear of the piston advance control port 503, a piston retraction control interlocking port 508 is formed separated from the piston advance control port 503 at a predetermined interval. In front of the piston retraction control port 504, a piston advance control interlocking port 509 is formed separated from the piston retraction control port 504 at a predetermined interval. Between the piston retraction control interlocking port 508 and the piston advance control interlocking port 509, an oil discharge port 505 is formed separated from both the piston retraction control interlocking port 508 and the piston advance control interlocking port 509 at predetermined intervals. Further, the piston advance control port 503 and the piston retraction control interlocking port 508 are in communication with a valve rear chamber 511 by way of a valve control passage 518, which will be described later, and the piston retraction control port 504 and the piston advance control interlocking port 509 are in communication with a valve front chamber 510 by way of a valve control passage 517, which will be described later.

In the cylinder 500, a valve chamber 541 is formed in a non-concentric manner with the piston 520, and a valve 526 is slidably fitted into the valve chamber 541. In the valve chamber 541, in order from the front to the rear, the valve front chamber 510, a valve retraction hold chamber 515, a main chamber 542, a valve advance hold chamber 516, and the valve rear chamber 511, are formed by annular steps. In the main chamber 542, a piston front chamber low pressure port 512, a piston high pressure port 514, and a piston rear chamber low pressure port 513 are disposed separated from each other at predetermined intervals from the front to the rear. To the intermediate section between the piston front chamber low pressure port 512 and the piston high pressure port 514 and the intermediate section between the piston high pressure port 514 and the piston rear chamber low pressure port 513, the piston front chamber passage 506 and the piston rear chamber passage 507 are connected, respectively.

The valve 526 is a solid valve body (spool) that has large-diameter sections 527, 528, and 529, medium-diameter sections 530 and 531 formed in front and the rear thereof, a small-diameter section 532 formed in front of the medium-diameter section 530, and a small-diameter section 533 formed in the rear of the medium-diameter section 531. Between the large-diameter section 527 and the large-diameter section 528 and between the large-diameter section 528 and the large-diameter section 529, a piston front chamber switching groove 534 and a piston rear chamber switching groove 535 are formed, respectively, in an annular manner. The small-diameter section 532 and the piston front chamber switching groove 534 are in communication with each other by way of a communication passage 536, and the small-diameter section 533 and the piston rear chamber switching groove 535 are in communication with each other by way of a communication passage 537.

The valve 526 is slidably fitted into the valve chamber 541 in such a way that the small-diameter section 532, the medium-diameter section 530, the large-diameter sections 527, 528, and 529, the medium-diameter section 531, and the small-diameter section 533 are positioned in the valve front chamber 510, the valve retraction hold chamber 515, the main chamber 542, the valve advance hold chamber 516, and the valve rear chamber 511, respectively. The valve 526 performing advance or retraction movements causes the large-diameter section 527 to open or close the piston front chamber low pressure port 512, the large-diameter section 528 to make the piston front chamber passage 506 and the piston high pressure port 514 communicate with or shut off from each other and, at the same time, to make the piston rear chamber passage 507 and the piston high pressure port 514 communicate with or shut off from each other, and the large-diameter section 529 to open or close the piston rear chamber low pressure port 513.

When the piston front chamber passage 506 comes into communication with the piston high pressure port 514, pressure in a valve retraction hold chamber 515 becomes high. Conversely, when the piston rear chamber passage 507 comes into communication with the piston high pressure port 514, pressure in a valve advance hold chamber 516 becomes high. The pressure receiving area of the valve front chamber 510 is set larger than that of the valve advance hold chamber 516. Similarly, the pressure receiving area of the valve rear chamber 511 is set larger than that of the valve retraction hold chamber 515.

Next, an operation of the above-described hydraulic hammering device will be described with reference to FIGS. 10A to 10D. In FIGS. 10A to 10D, passages to which a high pressure is applied are illustrated by "hatching".

When the valve 526 is switched to an advanced position, the piston high pressure port 514 comes into communication with the piston rear chamber passage 507, causing pressure in the piston rear chamber 502 to become high. On the other hand, since the piston front chamber low pressure port 512 is in communication with the piston front chamber passage 506 to cause pressure in the piston front chamber 501 to become low, the piston 524 advances. At this time, although pressure in both the valve front chamber 510 and the valve rear chamber 511 becomes low, pressure in the valve advance hold chamber 516 is high, causing the valve 526 to be held at the advanced position (see FIG. 10A).

Subsequently, when the piston 524 advances and the piston retraction control port 504 comes into communication with the piston rear chamber 502, pressure in the valve front chamber 510 becomes high. Since the pressure receiving area of the valve front chamber 510 is larger than that of the valve advance hold chamber 516, the valve 526 starts retracting. At this time, since the valve rear chamber 511 is in communication with the low pressure circuit 539 by way of the valve control passage 518, the piston retraction control interlocking port 508, and the oil discharge port 505, the valve 526 is able to retract without any problem (see FIG. 10B).

When it is assumed that a hydraulic circuit without the piston retraction control interlocking port 508 is used in a retraction phase of the valve 526 illustrated in FIG. 10B, since the piston large-diameter section 521 blocks the piston advance control port 503, the valve rear chamber 511 and the valve control passage 518 constitute a closed circuit, causing the valve 526 to be unable to retract. That is, it becomes clear that, when the valve front chamber 510 communicates with the high pressure circuit 538 by way of the piston retraction control port 504 and the piston rear chamber 502, the piston retraction control interlocking port 508 that communicates the valve rear chamber 511 with the low pressure circuit 539 by way of the oil discharge port 505 is indispensable to secure a retraction movement of the valve 526.

Immediately after the piston 520 has reached an impact point, the valve 526 completes switching to a retracted position thereof. When the valve is positioned at the retracted position, the piston front chamber 501 comes into communication with the piston high pressure port 514 to cause pressure in the piston front chamber 501 to become high, and the piston rear chamber 502 comes into communication with the piston rear chamber low pressure port 513 to cause pressure in the piston rear chamber 502 to become low, causing the piston 520 to turn to retraction. Although pressure in both the valve front chamber 510 and the valve rear chamber 511 becomes low, pressure in the valve retraction hold chamber 515 becomes high, causing the valve 526 to be held at the retracted position (see FIG. 10C).

When the piston 520 retracts to cause the piston advance control port 503 to come into communication with the piston front chamber 501, pressure in the valve rear chamber 511 becomes high, and, since the pressure receiving area of the valve rear chamber 511 is larger than that of the valve retraction hold chamber 515, the valve 526 starts advancing. At this time, since the valve front chamber 510 is in communication with the low pressure circuit 539 by way of the valve control passage 517, the piston advance control interlocking port 509, and the oil discharge port 505, the valve 526 is able to advance without any problem (see FIG. 10D). The valve 526 is switched to the advanced position again, and the above-described cycle is repeated to perform hammering.

When it is assumed that a hydraulic circuit without the piston advance control interlocking port 509 is used in an advance phase of the valve 526 illustrated in FIG. 10D, since the piston large-diameter section 522 blocks the piston retraction control port 504, the valve front chamber 510 and the valve control passage 517 constitute a closed circuit, causing the valve 526 to become unable to advance. That is, it becomes clear that, when the valve rear chamber 511 communicates with the high pressure circuit 538 by way of the piston advance control port 503 and the piston front chamber 501, the piston advance control interlocking port 509 that communicates the valve front chamber 510 with the low pressure circuit 539 by way of the oil discharge port 505 is indispensable to secure an advance movement of the valve 526.

SUMMARY

While the inventors have come to develop the piston front/rear chamber high/low pressure switching method aiming at achieving high output power for hydraulic hammering devices, the inventors have found that, at the same time, increasing efficiency and reducing a cost of hydraulic hammering devices are also important issues.

To achieve high efficiency of hydraulic hammering devices, which is the first issue, it is required to improve responsiveness of a valve and keep the quantity of hydraulic oil required for driving the valve low. To that end, miniaturizing a valve main body and forming the valve main body into a hollow shape are effective. To produce a hydraulic hammering device at low cost, which is the second issue, avoiding a complicated mechanism and simplifying a layout of ports and passages connecting the ports are effective.

Features in the structure of the above-described hydraulic hammering device of the piston front/rear chamber high/low pressure switching type, which is disclosed in JP 46-001590 A, will be summarized below.

1) The valve is driven by pressurized oil that is supplied to the front and rear chambers of the valve from the rear and front chambers of the piston. That is, in the technology disclosed in the literature, a front/rear chamber high/low pressure switching method is also employed for the valve as with the piston.

2) After the valve has been switched, pressure in the front chamber and the rear chamber of the valve becomes low at the same time. For this reason, in the technology disclosed in the literature, to maintain the position of the valve, it is required to have a valve hold mechanism in addition to the mechanism to move the valve to the front and rear. The valve hold mechanism is a configuration to supply and discharge pressurized oil to and from spaces formed by the valve medium-diameter sections and the valve advance (retraction) hold chambers.

3) To drive the valve, it is required to have a port (for example, the piston retraction control interlocking port) to open a path to a side (for example, the valve rear chamber) opposing a side to which pressure is applied (for example, the valve front chamber).

4) An oil discharge port that communicates the port to open a path, described in the item 3, with the low pressure circuit is included.

However, in the technology disclosed in the literature, since the valve hold mechanism described in the above-described item 2 is a configuration to supply and discharge pressurized oil to and from spaces formed by the valve medium-diameter sections and the valve advance (retraction) hold chambers, forming passages to supply and discharge the pressurized oil on the cylinder side is extremely difficult because of a small size of the valve. Thus, in the technology disclosed in the literature, while the above-described passages to supply and discharge pressurized oil are achieved as communication passages formed inside the valve main body, it becomes impossible, due to this configuration, to form the valve into a hollow structure (a structure having an axially penetrating hollow section). In consequence, there is a problem in that it is not possible to increase responsiveness of the valve and keep the quantity of hydraulic oil required for driving the valve low, which has led to a low hammering efficiency.

Since forming respective components in the above-described valve hold mechanism requires high-level processing accuracy and, for the multistep inner peripheral surface of the valve chamber (the inner surface of the valve chamber the inner diameter of which consecutively changes from a small-diameter to a medium-diameter to a large-diameter to a medium-diameter to a small-diameter) to which the valve main body is slidably fitted, processing itself has a high degree of difficulty, it is difficult to form these portions into a monolithic structure. Thus, there is another problem in that it is forced to employ a complicate structure, such as a combination of a plurality of members, to invite a high processing cost.

In the technology disclosed in the literature, since as many as five ports, namely, in order from the front, the piston advance control port 503, the piston retraction control interlocking port 508, the oil discharge port 505, the piston advance control interlocking port 509, and the piston retraction control port 504, open between the front chamber 501 and the rear chamber 502 of the piston 520, there is still another problem in that a processing cost of the ports opening between the front and rear chambers of the piston increases.

Since two ports on the front side are configured in such a way that, while merging at a location along the valve control passage (rear) 518, one ends and the other ends thereof communicate with the piston front chamber 501 and the valve rear chamber 511, respectively, and two ports on the rear side are configured in such a way that, while merging at a location along the valve control passage (front) 517, one ends and the other ends thereof communicate with the piston rear chamber 502 and the valve front chamber 510, respectively, the valve control passage (front) and the valve control passage (rear) communicate the piston front and rear chambers with the valve rear and front chambers, respectively. Thus, the passages are required to be arranged in such a way as to cross each other. In consequence, there is still another problem in that a passage layout (port layout) has a low degree of freedom and, thus, becomes extremely complicated to further invite a high processing cost.

Further, although, in the case in which the passage layout has a low degree of freedom, since the piston rear chamber passage connecting to the piston rear chamber, for example, requires a large quantity of oil when the piston advances, it is preferable to set passage areas large, there is a case in which passage areas cannot be enlarged due to a constraint on the passage layout. In general, having a large number of opening ports simply leads to a higher risk of causing leakage of pressurized oil. There is also an aspect that the risk may lead to a reduction in hammering efficiency.

Accordingly, the present invention is made focusing attention on such problems, and an object of the present invention is to provide a hydraulic hammering device employing a piston front/rear chamber high/low pressure switching method that achieves both an improvement in hammering efficiency and a low cost.

In order to achieve the object mentioned above, according to a first mode of the present invention, there is provided a hydraulic hammering device including: a cylinder; a piston that is slidably fitted into the inside of the cylinder; a piston front chamber and a piston rear chamber that are defined between an outer peripheral surface of the piston and an inner peripheral surface of the cylinder and are arranged separated from each other in axially front and rear direction; and a switching valve mechanism configured to switch each of the piston front chamber and the piston rear chamber into communication with either a high pressure circuit or a low pressure circuit in an interchanging manner; and which is configured to hammer a rod to be hammered, by making the piston advance and retract in the cylinder.

The piston has a large-diameter section, small-diameter sections that are individually disposed in front and the rear of the large-diameter section, and a valve switching groove that is formed substantially at an axially middle portion of the large-diameter section.

The switching valve mechanism has a valve chamber that is formed in the cylinder in a non-concentric manner with the piston, a valve that is slidably fitted into the valve chamber and has a piston high/low pressure switching section formed that is configured to, by the valve advancing or retracting, switch each of the piston front chamber and the piston rear chamber into communication with either the high pressure circuit or the low pressure circuit in an interchanging manner, a valve presser configured to always press the valve in either of advancing and retracting directions, and a valve controller configured to, when pressurized oil is supplied, move the valve to an opposite direction against pressing force by the valve presser.

The cylinder has three control ports including, in order from the front, a piston retraction control port, a valve control port, and a piston advance control port, between the piston front chamber and the piston rear chamber.

The valve control port is in communication with the valve controller in such a way as to be able to supply and discharge the pressurized oil and is always isolated from respective ones of the piston front chamber and the piston rear chamber.

The piston retraction control port and the piston advance control port, by only either one of the piston retraction control port and the piston advance control port communicating with the valve control port depending on an advancing or a retracting movement of the valve switching groove in association with an advance or a retraction of the piston, supply and discharge the pressurized oil to and from the valve controller to make the valve advance and retract, and the switching valve mechanism switches each of the piston front chamber and the piston rear chamber into communication with either the high pressure circuit or the low pressure circuit in an interchanging manner depending on an advancing or a retracting movement of the piston high/low pressure switching section in association with an advance or a retraction of the valve to supply and discharge hydraulic oil so that an advance and a retraction of the piston can be repeated.

According to the hydraulic hammering device according to the first mode of the present invention, since, when only either one port out of the piston retraction control port and the piston advance control port communicates with the valve control port depending on an advancing or a retracting movement of the valve switching groove in association with an advance or a retraction of the piston, the switching valve mechanism switches each of the piston front chamber and the piston rear chamber into communication with either a high pressure circuit or a low pressure circuit in an interchanging manner to supply and discharge hydraulic oil so that an advance and a retraction of the piston can be repeated, hammering using the piston front/rear chamber high/low pressure switching method enables hammering efficiency to be improved.

According to the switching valve mechanism in the hydraulic hammering device according to the first mode of the present invention, since the switching valve mechanism includes a valve presser that always presses the valve in one direction out of the advancing and retracting directions and a valve controller that, when pressurized oil is supplied, moves the valve in the opposite direction against the pressing force by the valve presser, the valve is always pressed in one direction and, when pressurized oil is supplied to the valve controller, the valve can be moved in the opposite direction against the pressing force. Thus, a valve hold mechanism, such as the one in the hydraulic hammering device in the above-described JP 46-001590 A, that is different from the mechanism to move the valve in the front and rear directions is not required. Therefore, processing of slidably-fitting portions of the valve becomes easy, enabling a processing cost to be reduced.

Since only three control ports, namely the piston retraction control port, the valve control port, and the piston advance control port, have openings between the piston front chamber and the rear chamber, the processing cost of the ports having openings between the front and rear chambers of the piston can also be reduced.

Further, since the circuits of the front and rear chambers of the piston and the valve control port that drives the valve are isolated (shut off) so as not to draw in hydraulic oil from each other, a passage layout has a high degree of freedom, enabling a processing cost to be further reduced. Since the passage layout has a high degree of freedom, it becomes possible to optimize passages connecting respective ports on the piston side and the valve side.

In the hydraulic hammering device according to the first mode of the present invention, it is preferable that the valve have a hollow structure that has an axially penetrating valve hollow passage. Since employing such a configuration causes the weight of the valve to be reduced, it is possible to improve the responsiveness of the valve to keep the quantity of hydraulic oil required for driving the valve low and improve hammering efficiency.

In the hydraulic hammering device according to the first mode of the present invention, it is preferable that the valve hollow passage be always connected to the high pressure circuit as a passage for hydraulic oil. Such a configuration is suitable to prevent cavitation from occurring at the front and rear stroke ends of the valve. In the configuration in which the valve hollow passage is always connected to the high pressure circuit as a passage for hydraulic oil, configuring a valve presser based on a difference in pressure receiving areas between the front end face and the rear end face of the valve is more suitable to simplify the configuration of the valve presser and reduce a cost.

In the hydraulic hammering device according to the first mode of the present invention, it is preferable that the piston retraction control port be always connected under high pressure. When such a configuration is employed, since the piston retraction control port disposed right behind the piston front chamber is always connected to the high pressure circuit, high pressure oil is always leaked and supplied to the large-diameter section of the piston located in front. Thus, the configuration is suitable to reduce occurrences of "galling" to the piston caused by oil film shortage on the large-diameter section of the piston. Since the control port on the piston front chamber side is always connected to the high pressure circuit, it is possible to prevent the vicinity of the front chamber from changing into a negative pressure state when the piston turns from retraction to advance. Thus, such a configuration is suitable to prevent the oil film shortage state from being promoted by occurrences of cavitation.

In the hydraulic hammering device according to the first mode of the present invention, it is preferable that the piston advance control port be composed of a short stroke port and a long stroke port, which are disposed separated in the front and rear direction, and a variable choke, which is variable from full close to full open, be disposed between the short stroke port and the valve low pressure passage. Employing such a configuration is equivalent to constituting a so-called "meter-out circuit" that controls the flow rate of pressurized oil discharged from the valve. Since, in general, a meter-out circuit has a higher controllability than a meter-in circuit, the meter-out circuit is a suitable configuration as a stroke adjustment mechanism for a hammering device, which is required to have a linear controllability with respect to a limited range of adjustment.

In the hydraulic hammering device according to the first mode of the present invention, it is preferable that an accumulator be disposed between a path to supply pressurized oil to the valve presser and the valve controller and a path to supply pressurized oil to the piston rear chamber. Since such a configuration has an accumulator disposed between a path to supply pressurized oil to the valve presser and the valve controller and a path to supply pressurized oil to the piston rear chamber, a shock in the pressurized oil produced in the piston rear chamber is absorbed by the accumulator. Thus, the shock in the pressurized oil does not propagate to the valve presser and the valve controller. In consequence, the behavior of the valve is not disturbed, and the configuration is suitable to stabilize hammering performance.

Furthermore, in order to achieve the object mentioned above, according to a second mode of the present invention, there is provided a hydraulic hammering device including: a cylinder; a piston that is slidably fitted into the inside of the cylinder; a piston front chamber and a piston rear chamber that are defined between an outer peripheral surface of the piston and an inner peripheral surface of the cylinder and are arranged separated from each other in axially front and rear direction; and a switching valve mechanism configured to switch each of the piston front chamber and the piston rear chamber into communication with either a high pressure circuit or a low pressure circuit in an interchanging manner; and which is configured to hammer a rod to be hammered, by making the piston advance and retract in the cylinder.

The piston has a large-diameter section, small-diameter sections that are individually disposed in front and the rear of the large-diameter section, and a valve switching groove that is formed substantially at an axially middle portion of the large-diameter section.

The switching valve mechanism has a valve chamber that is formed in the cylinder in a non-concentric manner with the piston, a valve that is slidably fitted into the valve chamber and has a piston high/low pressure switching section formed that is configured to, by the valve advancing or retracting, switch each of the piston front chamber and the piston rear chamber into communication with either the high pressure circuit or the low pressure circuit in an interchanging manner, a valve presser that always presses the valve in either of advancing and retracting directions, and a valve controller configured to, when pressurized oil is supplied, move the valve to an opposite direction against pressing force by the valve presser.

The cylinder has three control ports including, in order from the front, a piston retraction control port, a valve control port, and a piston advance control port, between the piston front chamber and the piston rear chamber.

The valve control port is in communication with the valve controller in such a way as to be able to supply and discharge the pressurized oil and is always isolated from respective ones of the piston front chamber and the piston rear chamber.

The piston retraction control port and the piston advance control port are configured to cause, in association with an advance of the piston, the valve switching groove to communicate with the piston retraction control port and the valve control port and the pressurized oil to be supplied to the valve controller to make the valve retract and, in association with a retraction of the piston, the valve switching groove to communicate with the piston advance control port and the valve control port and the pressurized oil to be discharged from the valve controller to make the valve advance, and the switching valve mechanism switches each of the piston front chamber and the piston rear chamber into communication with either the high pressure circuit or the low pressure circuit in an interchanging manner depending on an advancing or a retracting movement of the piston high/low pressure switching section in association with an advance or a retraction of the valve to supply and discharge hydraulic oil so that an advance and a retraction of the piston can be repeated.

According to the hydraulic hammering device according to the second mode of the present invention, since the hydraulic hammering device is, as with the hydraulic hammering device according to the first mode of the present invention, a hydraulic hammering device of a so-called "piston front/rear chamber high/low pressure switching type" that switches each of the piston front chamber and the piston rear chamber into communication with either a high pressure circuit or a low pressure circuit in an interchanging manner to repeat an advance and a retraction of the piston, it is possible to increase the number of strikes and achieve high output power. Since a valve hold mechanism that is different from a mechanism to move the valve to the front and rear is not required, processing of slidably-fitting portions of the valve is easy. Thus, a processing cost can be reduced.

In particular, according to the hydraulic hammering device according to the second mode of the present invention, since the piston front chamber is isolated from both the valve presser and the valve controller of the switching valve mechanism, there is no possibility that pulsation of the pressurized oil caused by an impact when the piston strikes a rod for hammering directly influences driving of the valve. Furthermore, since an advancing movement of the valve is driven by pressurized oil being discharged from the valve control chamber, even if pulsation that has not been completely attenuated remains in the entire high pressure paths, it becomes possible to reduce influence therefrom, causing the behavior of the valve to become stable.

According to the present invention, it is possible to provide a hydraulic hammering device employing a piston front/rear chamber high/low pressure switching method that achieves both an improvement in hammering efficiency and a low cost.

DETAILED DESCRIPTION

Hereinafter, embodiments and variations of the present invention will be described with reference to the drawings as appropriate. In all the drawings, the same signs are assigned to the same components. A component that has the same function as another component but the layout or shape of which is altered is indicated by adding an apostrophe to the same sign.

First Embodiment

Figure 1:
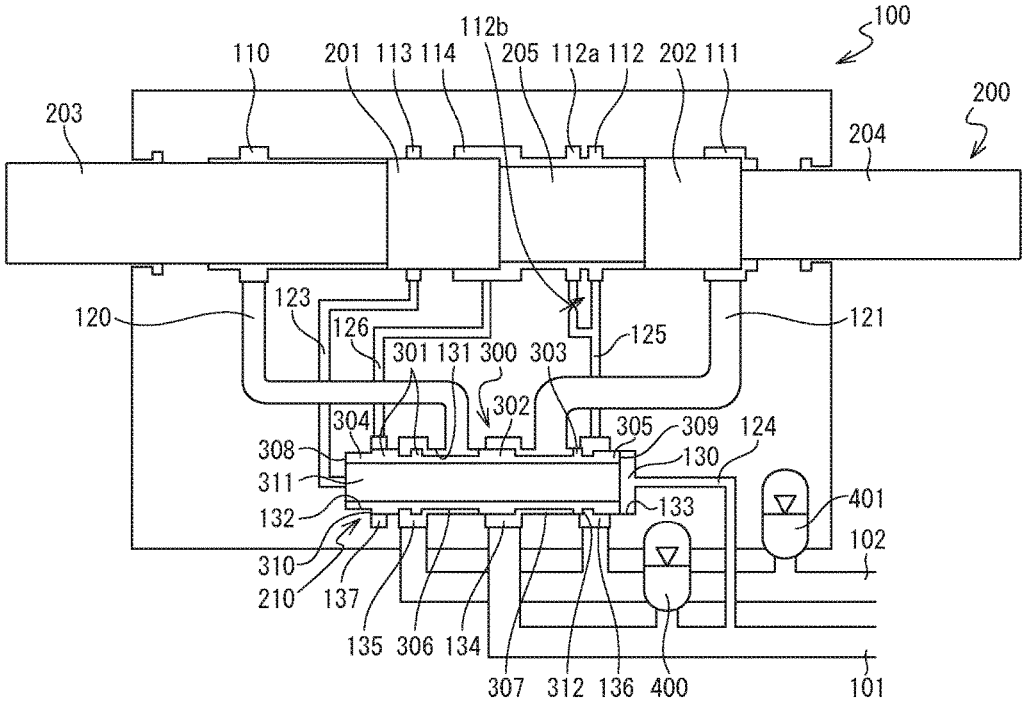
FIG. 1 is a schematic view of a first embodiment of a hydraulic hammering device of a piston front/rear chamber high/low pressure switching type according to the present invention.

As illustrated in FIG. 1, a hydraulic hammering device of a first embodiment includes a cylinder 100 and a piston 200 that is slidably fitted into the inside of the cylinder 100 so as to be slidably movable along the axial direction. The piston 200 has a large-diameter section (front) 201 and a large-diameter section (rear) 202 in the axially middle portion, and small-diameter sections 203 and 204 that are formed in front and the rear of the large-diameter sections 201 and 202, respectively. Substantially in the middle between the piston large-diameter sections 201 and 202, an annular valve switching groove 205 is formed at only one location.

The piston 200 being disposed in such a way as to be slidably fitted in the cylinder 100 causes a piston front chamber 110 and a piston rear chamber 111 to be defined separated from each other in the axially front and rear direction, respectively, between the outer peripheral surface of the piston 200 and the inner peripheral surface of the cylinder 100. Inside the cylinder 100, a switching valve mechanism 210 is disposed that switches each of the piston front chamber 110 and the piston rear chamber 111 into communication with either a high pressure circuit 101 or a low pressure circuit 102 in an interchanging manner to supply and discharge hydraulic oil so that an advance and a retraction of the piston 200 can be repeated.

The switching valve mechanism 210 includes, inside the cylinder 100, a valve chamber 130 formed in a non-concentric manner with the piston 200 and a valve (spool) 300 slidably fitted into the valve chamber 130. In the valve chamber 130, in order from the front to the rear, a valve chamber small-diameter section 132, a valve chamber large-diameter section 131, and a valve chamber medium-diameter section 133 are formed by multiple annular grooves. On the valve chamber large-diameter section 131, a valve control chamber 137, a piston front chamber low pressure port 135, a piston high pressure port 134, and a piston rear chamber low pressure port 136 are disposed separated from each other at predetermined intervals from the front to the rear.

To the piston front chamber 110, a piston front chamber passage 120 that communicates the piston front chamber 110 with either the high pressure circuit 101 or the low pressure circuit 102 depending on switching of the valve 300 between an advance and a retraction is connected. On the other hand, to the piston rear chamber 111, a piston rear chamber passage 121 that communicates the piston rear chamber 111 with either the high pressure circuit 101 or the low pressure circuit 102 depending on switching of the valve 300 between an advance and a retraction is connected. To the high pressure circuit 101 and the low pressure circuit 102, a high pressure accumulator 400 and a low pressure accumulator 401 are disposed, respectively.

Between the piston front chamber 110 and the piston rear chamber 111, a piston retraction control port 113, a valve control port 114, and piston advance control ports 112 and 112*a* are disposed separated from each other at predetermined intervals from the front to the rear. With regard to the piston advance control ports, a long stroke port 112 for a normal stroke and a short stroke port 112*a* are disposed at two positions separated in the front and rear direction, respectively. The piston advance control port on the piston front chamber 110 side is a port for a short stroke provided with a variable choke 112*b*, which is variable from full close to full open. A description will be made herein under an assumption that the piston advance control ports are set to the normal stroke, that is, the variable choke 112*b* is set to a full close state and the long stroke port on the piston rear chamber 111 side is set to operate as the piston advance control port 112.

Figure 2:
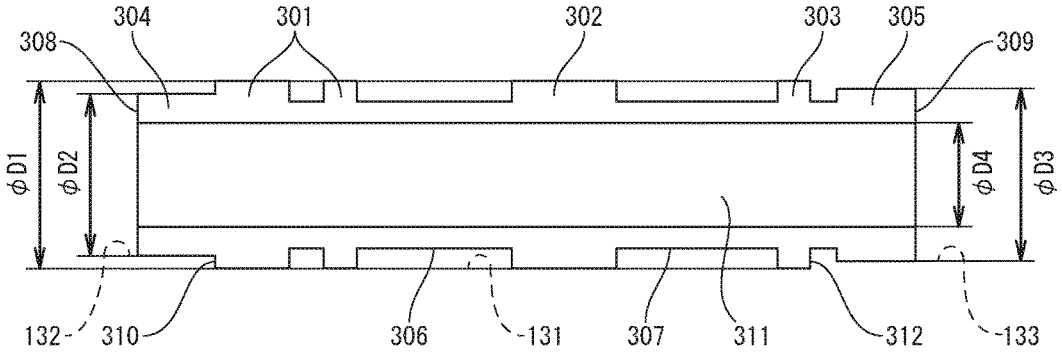
FIG. 2 is an explanatory diagram of a valve main body in the hydraulic hammering device according to the first embodiment.

As illustrated in FIG. 2, the valve 300 is a hollow cylindrical shaped valve body that has an axially penetrating valve hollow passage 311. The valve 300 has, on the outer peripheral surface, valve large-diameter sections 301, 302, and 303, a valve small-diameter section 304 disposed in front of the valve large-diameter section 301, and a valve medium-diameter section 305 disposed in the rear of the valve large-diameter section 303. An annular piston front chamber switching groove 306 and an annular piston rear chamber switching groove 307 are formed between the valve large-diameter section 301 and the valve large-diameter section 302 and between the valve large-diameter section 302 and the valve large-diameter section 303, respectively. In the embodiment, these piston front chamber switching groove 306 and piston rear chamber switching groove 307 correspond to a "piston high/low pressure switching section", which is described in the summary section above.

The switching valve mechanism 210 is configured so that the valve large-diameter sections 301, 302, and 303, the valve small-diameter section 304, and the valve medium-diameter section 305 can be slidably fitted into the valve chamber large-diameter section 131, the valve chamber small-diameter section 132, and the valve chamber medium-diameter section 133, respectively.

The front end face and the rear end face of the valve 300 are a valve front end face 308 and a valve rear end face 309, respectively. At boundaries between the valve small-diameter section 304 and the valve large-diameter section 301 and between the valve large-diameter section 303 and the valve medium-diameter section 305, a valve stepped face (front) 310 and a valve stepped face (rear) 312 are formed, respectively.

When it is assumed that the outer diameter of the valve large-diameter sections 301, 302, and 303 is denoted by ϕD1, the outer diameter of the valve small-diameter section 304 is denoted by ϕD2, and the outer diameter of the valve medium-diameter section 305 is denoted by ϕD3, and the inner diameter of the valve hollow passage 311 is denoted by ϕD4, relations between ϕD1 to ϕD4 are expressed by the expression 1 below.

$$\phi D4<\phi D2<\phi D3<\phi D1 \quad \text{(Expression 1)}$$

When it is assumed that the pressure receiving areas of the valve front end face 308, the valve rear end face 309, the valve stepped face (front) 310, and the valve stepped face (rear) 312 are denoted by S1, S2, S3, and S4, respectively, the pressure receiving areas are expressed by the expression 2 below.

$$S1=\pi/4\times(D2^2-D4^2)$$

$$S2=\pi/4\times(D3^2-D4^2)$$

$$S3=\pi/4\times(D1^2-D2^2)$$

$$S4=\pi/4\times(D1^2-D3^2) \quad \text{(Expression 2)}$$

Relations between the pressure receiving areas S1 to S4 are expressed by the expressions 3 to 5 below.

$$S1<S2 \quad \text{(Expression 3)}$$

$$[S1+S3]>S2 \quad \text{(Expression 4)}$$

$$S3>S4 \quad \text{(Expression 5)}$$

The high pressure circuit 101 is connected to the piston high pressure port 134, and the low pressure circuit 102 is connected to both the piston front chamber low pressure port 135 and the piston rear chamber low pressure port 136.

One end and the other end of the piston front chamber passage 120 are connected to the piston front chamber 110 and the intermediate section between the piston high pressure port 134 and piston front chamber low pressure port 135 of the valve chamber large-diameter section 131, respectively. One end and the other end of the piston rear chamber passage 121 are connected to the piston rear chamber 111 and the intermediate section between the piston high pressure port 134 and piston rear chamber low pressure port 136 of the valve chamber large-diameter section 131, respectively.

A valve high pressure passage (front) 123 connects the piston retraction control port 113 to the front side end face of the valve chamber 130, and a valve high pressure passage (rear) 124 connects the rear side end face of the valve chamber 130 to a position on the upper stream side (the right side in FIG. 1) of the high pressure circuit 101 than the high pressure accumulator 400. Thus, a high pressure is always applied to the valve hollow passage 311. The valve high pressure passage (front) 123 may connect the piston retraction control port 113 to the valve high pressure passage (rear) 124.

A valve low pressure passage 125 connects the piston advance control port 112 to the piston rear chamber low pressure port 136. A valve control passage 126 connects the valve control port 114 to the valve control chamber 137. The valve low pressure passage 125 may connect the piston advance control port 112 to the low pressure circuit 102.

Next, an operation and operational effects of the hydraulic hammering device of the embodiment will be described with reference to FIGS. 3A to 3D. In FIGS. 3A to 3D, passages that are in a high pressure state are illustrated by "hatching".

Figures 3A, 3B, 3C, 3D:
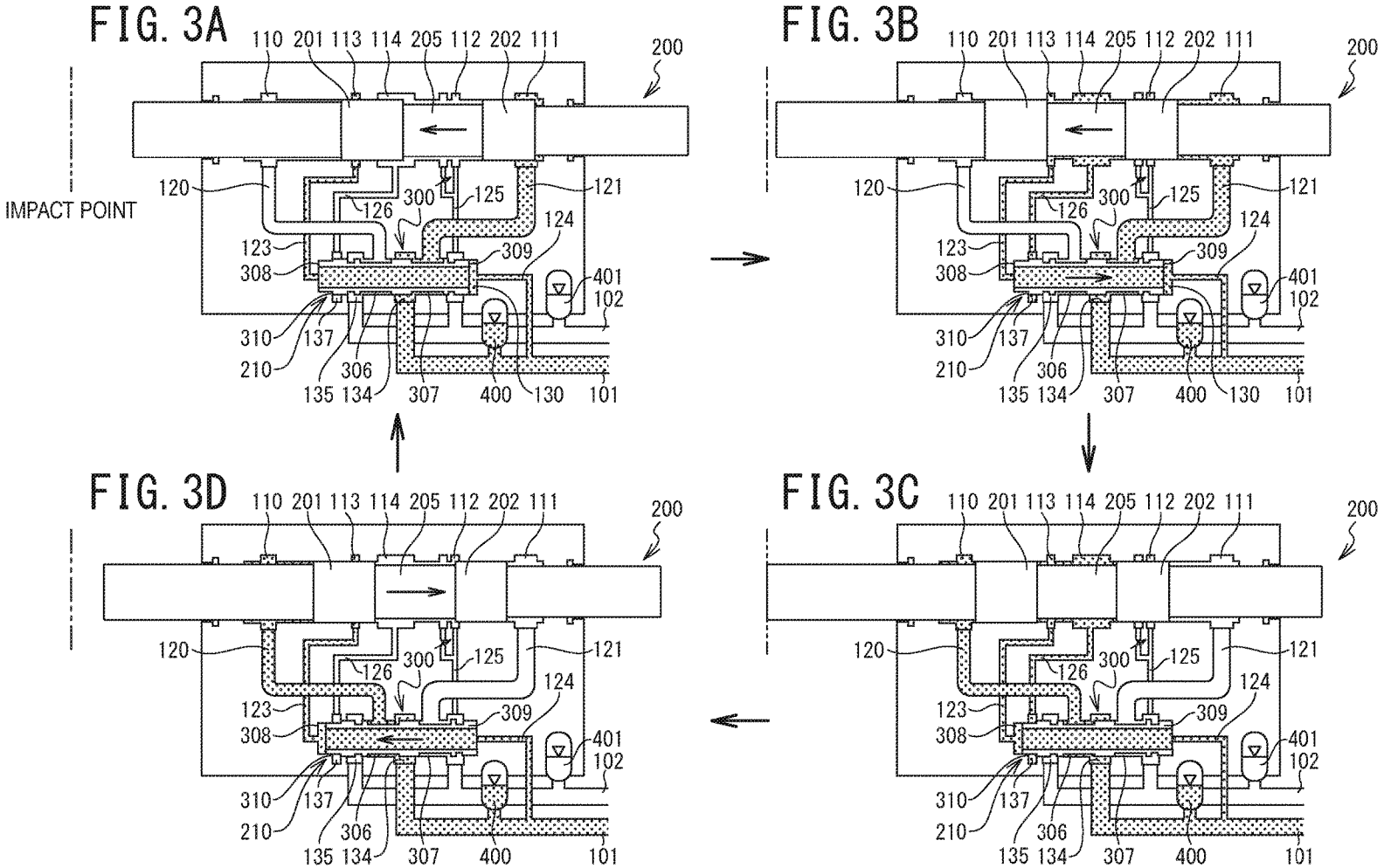
FIGS. 3A to 3D are operating principle diagrams of the hydraulic hammering device according to the first embodiment.

When, as illustrated in FIG. 3A, the valve 300 in the switching valve mechanism 210 is switched to an advanced position, the piston high pressure port 134 comes into communication with the piston rear chamber passage 121, causing pressure in the piston rear chamber 111 to become high. On the other hand, the piston front chamber low pressure port 135 comes into communication with the piston front chamber passage 120, causing pressure in the piston front chamber 110 to become low. With this operation, the piston 200 advances.

During this operation, the valve chamber 130 is always connected to the high pressure circuit 101 by way of the valve high pressure passage (rear) 124, causing pressure at both the valve front end face 308 and the valve rear end face 309 to be kept high. Since a high pressure is applied to both the valve front end face 308 and the valve rear end face 309, the valve 300 is held at the advanced position due to the above-described expression 3 (see FIG. 3A).

In the embodiment, the configuration to always apply advancing thrust force to the valve 300 based on differences in pressure receiving areas between the valve front end face 308 and the valve rear end face 309 corresponds to the "valve presser", which is described in the summary section above.

Subsequently, the piston 200 advances, the communication between the valve control port 114 and the piston advance control port 112 is cut off, and, instead, the valve control port 114 comes into communication with the piston retraction control port 113. With this operation, high pressure oil from the valve high pressure passage (front) 123 is supplied to the valve control chamber 137 by way of the valve control passage 126. When pressure in the valve control chamber 137 becomes high, a high pressure is applied to the stepped face 310, causing the valve 300 to start retracting due to the above-described expression 4 (see FIG. 3B).

In the embodiment, the configuration in which high pressure oil being supplied to the valve control chamber 137 causes the valve 300 to retract against the above-described always-applied advancing thrust force (equivalent to pressing force by a valve pressing means) corresponds to the above-described "valve controller".

The piston 200 reaches an impact point when hammering efficiency is maximum (at a middle point between FIGS. 3B and 3C), and, at the impact point, the tip of the piston 200 hammers the rear-end of a rod for hammering (not illustrated). With this operation, a shock wave produced by hammering propagates to a bit or the like at the tip of the rod by way of the rod to be used as energy to crush bedrock or the like.

Immediately after the piston 200 has reached the impact point, the valve 300 completes switching to a retracted position thereof. At the valve retracted position, the piston high pressure port 134 comes into communication with the piston front chamber passage 120, causing pressure in the piston front chamber 110 to become high. On the other hand, the piston rear chamber low pressure port 136 comes into communication with the piston rear chamber passage 121, causing pressure in the piston rear chamber 111 to become low. With this operation, the piston 200 turns to retraction. While pressure in the valve control chamber 137 is kept high, the valve 300 is held at the retracted position (see FIG. 3C).

Subsequently, the piston 200 retracts, the communication between the valve control port 114 and the piston retraction control port 113 is cut off, and, instead, the valve control port 114 comes into communication with the piston advance control port 112. With this operation, the valve control chamber 137 is connected to the low pressure circuit 102 by way of the valve control passage 126 and the valve low pressure passage 125. When pressure in the valve control chamber 137 becomes low, the valve 300 starts advancing due to the above described expression 3 (see FIG. 3D). The valve 300 is switched to the advanced position again, and the above-described hammering cycle is repeated.

Features in the above-described configuration of the embodiment will now be summarized in the following items 1 to 4.

Item 1) While the mechanism to drive the valve 300, as described above, includes the valve pressing means and the valve control means, among these means, the hydraulic circuits of the valve pressing means do not have any relation with the movements of the piston 200, and the respective hydraulic circuits constituting the valve control means are arranged between the piston front chamber 110 and the piston rear chamber 111 and without communicating with the piston front chamber 110 and the piston rear chamber 111 (always isolated so as not to draw in hydraulic oil from each other).

Item 2) The mechanism to drive the valve 300 includes the valve pressing means and the valve control means, and the valve pressing means always presses the valve 300 in one direction and switches between an advance and a retraction of the valve 300 by means of supplying and discharging pressurized oil to and from the valve control chamber 137.

Item 3) Only one port, that is, the valve control port 114, is connected to the valve control chamber 137.

Item 4) The valve 300 is formed into a hollow structure that has the axially penetrating valve hollow passage 311.

The structural features of the embodiment summarized in the above-described items 1 to 4 will be compared with the conventional hydraulic hammering device of the piston front/rear chamber high/low pressure switching type that was described with reference to FIGS. 9 and 10A to 10D.

With respect to Item 1:

In the above-described conventional technology, the piston front and rear chambers and the respective circuits related to driving the valve are related in such a way as to communicate with one another. Thus, the circuit configuration has a low degree of freedom for layout. On the other hand, with regard to the structure of the embodiment, since the hydraulic circuits of the valve pressing means do not have any relation with the movements of the piston 200 and are isolated from the piston front and rear chambers so as not to draw in hydraulic oil from each other, the piston front and rear chambers and the respective circuits related to driving the valve are independent of each other. Therefore, it can be said that, with regard to the structure of the embodiment, the circuit configuration has a higher degree of freedom for layout than in the above-described conventional technology.

Figure 9:
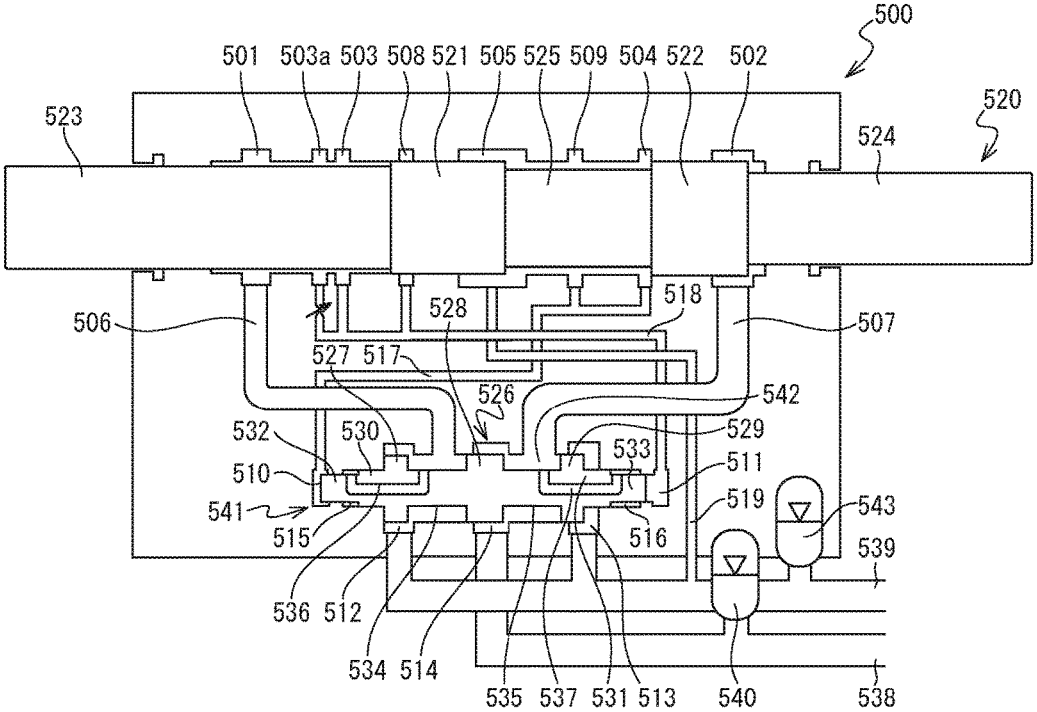
FIG. 9 is a schematic view of a conventional hydraulic hammering device of a piston front/rear chamber high/low pressure switching type.
Figure 10B:
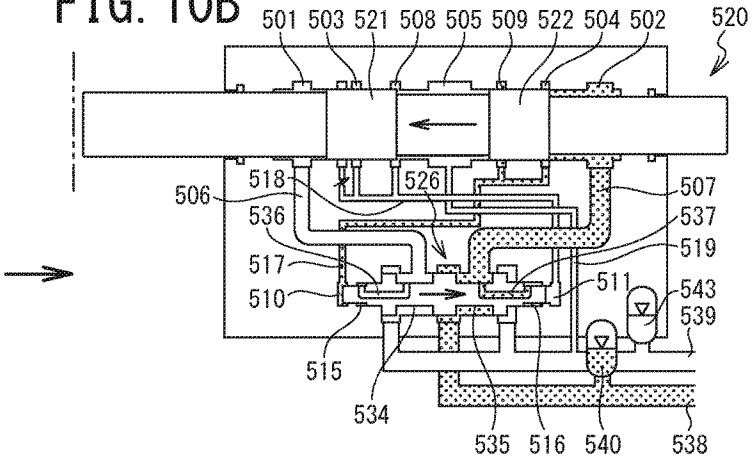
FIGS. 10A to 10D are operating principle diagrams of the conventional hydraulic hammering device of the piston front/rear chamber high/low pressure switching type.
Figure 10C:
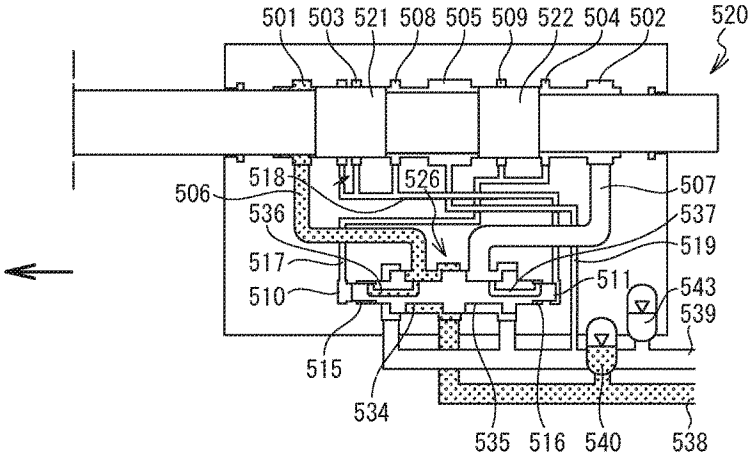
Figure 10A:
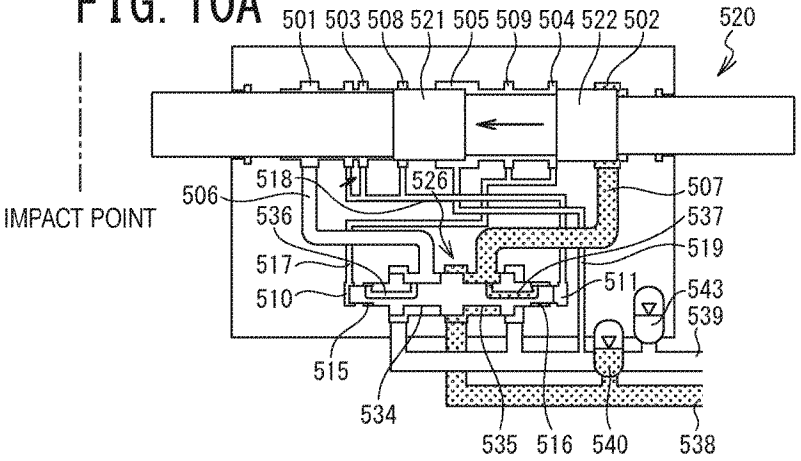
Figure 10D:
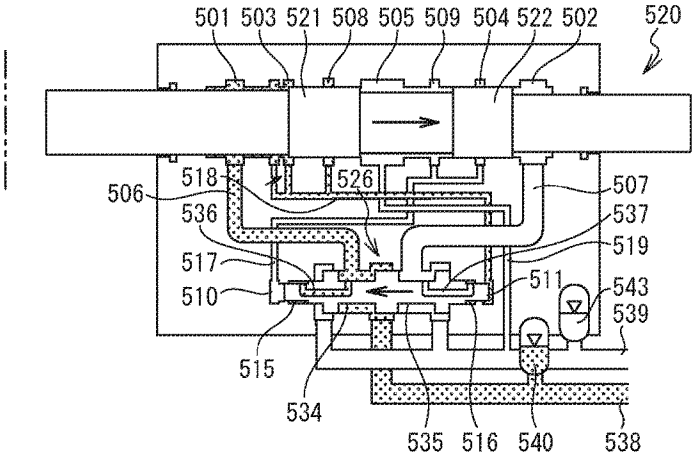

In particular, in the above-described conventional technology, since the circuit configuration has a low degree of freedom for layout, it is required to dispose both passages to supply and discharge pressurized oil on the advance side and the retraction side individually to drive the valve. Thus, as illustrated in FIG. 9, it is required to dispose passages to drive the valve at five locations between the front chamber and the rear chamber of the piston. On the other hand, in the case of the embodiment, as illustrated in FIG. 1, it is required to dispose passages at only three locations, that is, the piston retraction control port 113, the valve control port 114, and the piston advance control port 112.

A structure with a small number of passages directly leads to a reduction in processing cost. Circuit configuration having a high degree of freedom for layout enables the piston rear chamber, the valve, and the accumulator to be arranged in a concentrated manner to shorten the length of passages. With this configuration, it is possible to improve hydraulic efficiency, and it is also possible to enlarge the passage area of the piston rear chamber passage 121, which is connected to the piston rear chamber 111, to cope with a large quantity of oil.

Further, it can be seen that, since not only is the number of passages plenty, but also, as illustrated in FIG. 9, the front chamber and the rear chamber of the piston being connected to the rear chamber and the front chamber of the valve, respectively, causes the hydraulic circuits to be arranged in such a way as to cross one another, the hydraulic circuit of the above-described conventional technology has a substantially complicated layout. On the other hand, as illustrated in FIG. 1, the structure of the embodiment has a very simple circuit configuration. In consequence, it is possible to reduce a processing cost.

In particular, according to the hydraulic hammering device of the embodiment, since the piston front chamber 110 is isolated from both the "valve pressing means" and the "valve control means" of the switching valve mechanism 210, there is no possibility that pulsation of the pressurized oil caused by the impact of the tip of the piston 200 striking a rod for hammering directly influences driving of the valve 300. Furthermore, since an advance movement of the valve 300 is driven by the pressurized oil being discharged from the valve control chamber 137, even if pulsation that has not been completely attenuated remains in the entire high pressure paths, it becomes possible to reduce influence therefrom, causing the behavior of the valve 300 to become stable.

Although, since the hydraulic hammering device of the embodiment is a hydraulic hammering device of a so-called "piston front/rear chamber high/low pressure switching type", which repeats an advance and a retraction of the piston 200 by switching each of the piston front chamber 110 and the piston rear chamber 111 into communication with either the high pressure circuit 101 or the low pressure circuit 102 in an interchanging manner, increasing the number of strikes enables high output power to be obtained, it is required to avoid disruption in the behavior of the valve 300 because of the high number of strikes. For this reason, it can be said that a hydraulic hammering device suitable for high output power has been achieved.

With respect to Item 2:

Since the hydraulic hammering device of the above-described conventional technology employs the valve front/rear chamber high/low pressure switching method and includes a valve hold mechanism that holds the valve at the timings when pressure in both the front and rear chambers of the valve becomes low, the valve structure is required to have, as an outer circumferential shape that is slidably fitted into the valve chambers, a shape of multistep structure having as many as five steps, namely, from the front to the rear, a small-diameter section, a medium-diameter section, a large diameter section, a medium diameter section, and a small-diameter section, as illustrated in FIG. 9. Further, two supply and discharge passages for pressurized oil to hold the valve are required to be disposed on the front side and the rear side. On the other hand, the valve structure of the embodiment has only three steps, namely a small-diameter section, a large-diameter section, and a medium-diameter section, and it is not required to process, to the valve, a supply and discharge passage for a hold mechanism of the valve itself, enabling the structure itself of the valve to be extremely simple. Simplicity in the valve structure of the embodiment makes it possible not only to reduce a processing cost of the valve itself but also, needless to say, to substantially reduce a cost of processing the valve chamber corresponding thereto, that is, a cost of processing the inner circumference of the cylinder.

With respect to Item 3:

In the above-described conventional technology, while the valve front chamber is connected to two ports, namely the piston advance interlocking control port and the piston retraction control port, by way of the valve control passage (front), in the valve retraction phase (FIG. 10B), the piston advance control interlocking port performs a function of discharging pressurized oil in the valve front chamber in the valve advance phase to the oil discharge port, which is a primary function thereof, but, at the same time, becomes a cause for pressurized oil in the piston retraction control port to leak to the oil discharge port (this phenomenon also applies to the piston retraction control interlocking port in the valve retraction phase). In general, in a hammering device, a greater number of ports cause a greater number of points from which pressurized oil leaks.

On the other hand, in the structure of the embodiment, when focusing on the valve control chamber 137, only one port, that is, the valve control port 114, is connected thereto by way of the valve control passage 126, enabling the quantity of leakage to be kept to a minimum.

In the embodiment, while, in a period between FIGS. 3C and 3D, that is, in a period from the time when the valve control port 114 departs from a state of communication with the piston retraction control port 113 to the time when the valve control port 114 comes into communication with the piston advance control port 112, the valve control chamber 137 is transformed into a closed circuit by the piston large-diameter section (rear) 202 and pressurized oil being sealed in the closed circuit holds the valve 300 at the retracted position, it can be said that only one port is preferably connected to the valve control port 114 because a large quantity of leakage while in a state in which pressurized oil is not supplied makes the behavior of the valve 300 unstable. As described above, in the embodiment, the valve control port 114 is set not only to reduce the quantity of leakage of pressurized oil to increase hammering efficiency but also to stabilize the behavior of the valve 300.

With respect to Item 4:

In the above-described conventional technology, since oil supply and discharge passages constituting a valve hold mechanism are disposed to the inside of the valve, the valve has a solid structure. On the other hand, in the embodiment, since the valve 300 has a hollow structure that has the axially penetrating valve hollow passage 311, employing the hollow structure to the valve enables a reduction in the weight to be achieved. Thus, it is possible to reduce the quantity of oil consumed to drive the valve and to improve hammering efficiency.

As described thus far, the hydraulic hammering device employing the piston front/rear chamber high/low pressure switching method of the embodiment, while having a high hammering power based on the piston front/rear chamber high/low pressure switching, enables a processing cost to be reduced and hydraulic efficiency to be improved compared with a conventional hydraulic hammering device.

In general, in a hydraulic hammering device, there is a case in which, at the front and rear stroke ends of a valve, a negative pressure caused by being connected to a low pressure circuit is exerted to decrease pressure to less than or equal to the atmospheric pressure, and, in such a case, occurrences of cavitation becomes a problem. On the other hand, in the embodiment, since pressure in the valve hollow passage 311, at the valve front end face 308, and at the valve rear end face 309 is always high, occurrences of cavitation can be suppressed compared with a case in which any one of these locations turns to low pressure.

Since, in an intermediate stage in which a state of FIG. 3D changes to a state of FIG. 3A in the embodiment, that is, in the period for which the valve 300 moves to the front end position, pressure in the piston front chamber 110 becomes low, pressure in the piston rear chamber 111 becomes high, and the piston 200 retracts to the rear stroke end while decelerating, pressure in both the piston front chamber 110 and the valve control port 114 becomes low, the piston large-diameter section (front) 201 is subjected to a condition that is likely to cause oil film shortage and cavitation to occur. On the other hand, in the embodiment, since pressure at the piston retraction control port 113 is always high and a small amount of pressurized oil leaks therefrom, occurrences of oil film shortage and cavitation can be suppressed.

In the hydraulic hammering device of the embodiment, since the piston advance control port 112 is connected to the low pressure circuit 102 by way of the valve low pressure passage 125, the short stroke port 112*a* and the variable choke 112*b* are connected under low pressure. Therefore, in the case in which the variable choke 112*b* is adjusted, when the piston 200 retracts to cause the valve control port 114 and the short stroke port 112*a* to communicate with each other through the valve switching groove 205, high pressure oil in the valve control port 114, the valve control passage 126, and the valve control chamber 137 is discharged to the low pressure circuit 102 by way of the short stroke port 112*a* and the variable choke 112*b*, causing the valve 300 to turn to an advance.

That is, the hydraulic circuits of the embodiment constitute a so-called "meter-out circuit", which controls the flow rate of pressurized oil discharged from the valve 300, which functions as an actuator. In general, since a meter-out circuit has a higher controllability than a meter-in circuit, the meter-out circuit is a suitable configuration as a stroke adjustment mechanism for a hammering device, which is required to have a linear controllability with respect to a limited range of adjustment.

In the hydraulic hammering device of the embodiment, the switching valve mechanism 210 has a structure in which the high pressure accumulator 400 is interposed between the passages constituting the valve control means and the valve pressing means, that is, the valve high pressure passage (rear) 124, the hollow passage 311, the valve high pressure passage (front) 123, the piston retraction control port 113, the valve control port 114, and the valve control passage 126 (hereinafter, referred to as "valve driving circuit"), and the passages through which pressurized oil is supplied to the piston rear chamber 111, that is, the piston high pressure port 134 and the piston rear chamber passage 121.

In the hydraulic hammering device of the embodiment, when the piston 200 hammers a rod at the impact point (between FIGS. 3B and 3C), the piston 200 stops abruptly in the rear chamber 111. While so-called water hammer produces a shock wave in the pressurized oil due to the abrupt stop, since the valve 300 has not reached the rear end of a stroke completely at this time, the shock wave in the pressurized oil propagates to all passages connected under high pressure. Since the above-described "valve driving circuit" is connected under high pressure, there is a possibility that propagation of the shock wave due to water hammer causes the behavior of the valve 300 to become unstable.

On the other hand, in the embodiment, since the valve high pressure passage 124 connects the valve hollow passage 311 to a location on the upper stream side of the high pressure circuit 101 than the high pressure accumulator 400, the high pressure accumulator 400 is interposed between the piston rear chamber 111 and the valve driving circuit. Thus, the shock wave in the pressurized oil can be suppressed from reaching the valve control chamber 137 and the valve front end face 308 and the valve rear end face 309 in the valve chamber 130. Thus, pressing force pressing the valve 300 in the advance direction and retracting thrust force working counter to the pressing force become stable. Therefore, the behavior of the valve 300 becomes stable, causing hammering performance to become stable.

Hereinafter, variations of the embodiment and another embodiment will be further described.

First Variation

Figure 4:
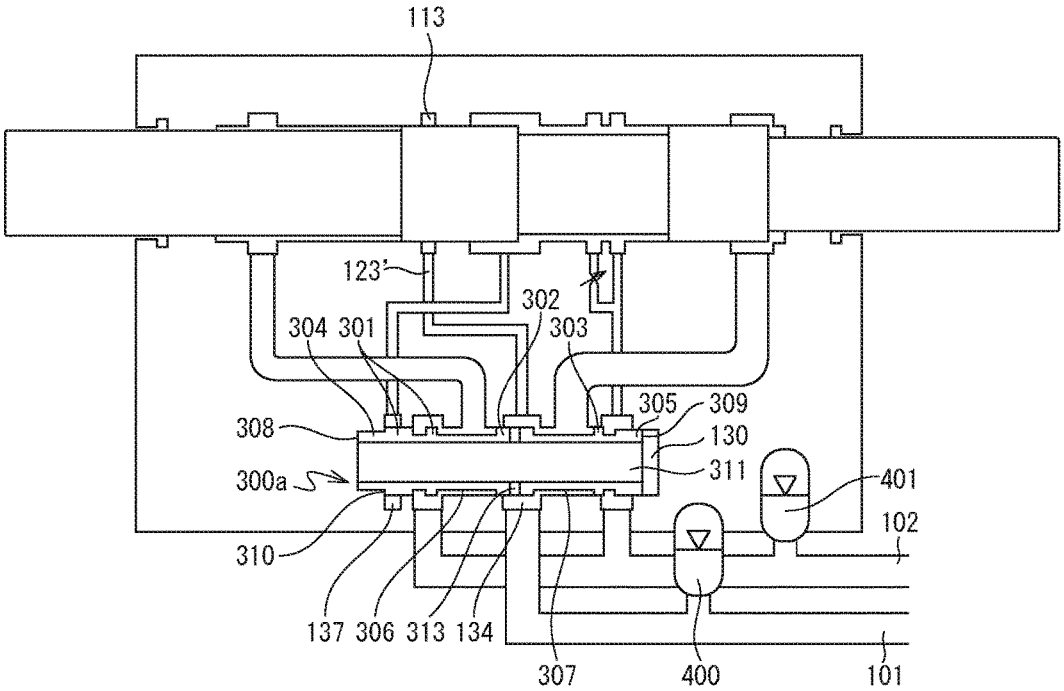
FIG. 4 is a schematic view of a hydraulic hammering device of a first variation of the first embodiment that has a high pressure passage formed inside a valve.

A first variation of the above-described first embodiment is illustrated in FIG. 4. As illustrated in the drawing, the first variation is an example in which, in a valve large-diameter section 302 of a valve 300*a*, a valve main body high pressure passage 313 that penetrates the valve large-diameter section 302 in a radial direction is formed in substitution for the valve high pressure passage 124 illustrated in FIG. 1. In this example, one end of a valve high pressure passage 123' is connected to a piston high pressure port 134. However, as with the example illustrated in FIG. 1, one end of the valve high pressure passage 123' may be connected to the front end face of a valve chamber 130. To prevent the afore-described vibration in pressurized oil produced when a piston performs hammering from reaching a valve control chamber 137, one end of the valve high pressure passage 123' may be connected to a location on the upper stream side of the high pressure circuit 101 than a high pressure accumulator 400.

According to the first variation, the valve high pressure passage (rear) 124 in FIG. 1 can be omitted. In consequence, it becomes possible to further simplify the configuration of hydraulic circuits, enabling a processing cost to be reduced. Since the valve main body high pressure passage 313 is a radially penetrating through-hole that does not have a bend in the intermediate section thereof unlike communication passages in conventional valve hold mechanisms, the valve main body high pressure passage 313 is substantially easily processed.

However, differing from the above-described first embodiment, in the first variation, the high pressure accumulator 400 is not interposed between a valve pressing means (a hollow passage 311, a valve front end face 308, and a valve rear end face 309) and a piston rear chamber 111. Thus, compared with the above-described first embodiment illustrated in FIG. 1, stability of the behavior of the valve 300*a* when water hammer occurs is reduced.

Second Variation

Figure 5:
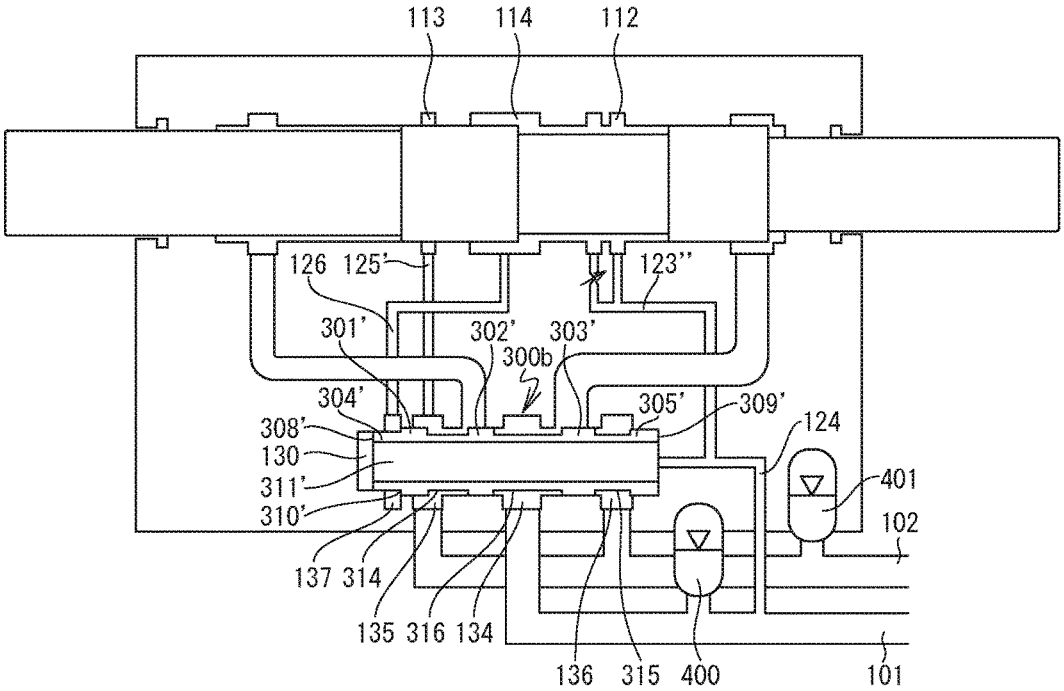
FIG. 5 is a schematic view of a hydraulic hammering device of a second variation of the first embodiment that is provided with a valve of a reverse acting type.

A second variation of the above-described first embodiment is illustrated in FIG. 5. The second variation is an example in which the groove structure of a valve main body and the circuit configuration of a valve control means are changed. As illustrated in the drawing, the second variation is a case in which relations of movement between a piston and a valve are reversed from those in the first embodiment illustrated in FIG. 1 (reverse acting valve).

Specifically, as illustrated in FIG. 5, a valve 300*b* is a hollow cylindrical shaped valve body in which an axially penetrating valve hollow passage 311' is formed. The valve 300*b* has valve large-diameter sections 301', 302', and 303', a valve small-diameter section 304' formed in front of the valve large-diameter section 301', and a valve medium-diameter section 305' formed in the rear of the valve large-diameter section 303'. Between the valve large-diameter section 301' and the valve large-diameter section 302', a piston front chamber oil discharge groove 314 is formed. Between the valve large-diameter section 303' and the valve medium-diameter section 305', a piston rear chamber oil discharge groove 315 is formed. Further, between the valve large-diameter section 302' and the valve large-diameter section 303, a piston front/rear chamber switching groove 316 is formed.

The front end face and the rear end face of the valve 300*b* are a valve front end face 308' and a valve rear end face 309', respectively. At the boundary between the valve small-diameter section 304' and the valve large-diameter section 301', a valve stepped face (front) 310' is formed.

A valve high pressure passage (front) 123" connects a piston advance control port 112 to a valve high pressure passage (rear) 124. A valve low pressure passage 125' connects a piston retraction control port 113 to a piston front chamber low pressure port 135. A valve control passage 126, as with the first embodiment illustrated in FIG. 1, connects a valve control port 114 to a valve control chamber 137. With this configuration, according to the second variation, relations of movement between the piston and the valve become reversed from those in the first embodiment illustrated in FIG. 1 (reverse acting valve).

The most distinctive feature of the second variation is that the piston advance control port 112 is always connected to a high pressure circuit. As described above, in a hydraulic circuit of a hammering device, while cavitation is likely to occur at a location connected under low pressure, locations at which cavitation that has occurred explodes to invite erosion include a closed space in which cavitation stagnates and a location that has a complicated shape, and, in the hammering device of the first embodiment, the short stroke port 112*a* of the piston advance control port 112 corresponds to such a location.

Therefore, in the examples illustrated in FIGS. 1 and 4, since the short stroke port 112*a* being always connected under low pressure causes erosion to become likely to occur at such a location, there is a case in which it is preferable to employ the second variation. In particular, when a variable choke is set to the full close (that is, when the hammering device is used at a work site where the hammering device is operated using only long stroke movements), employing the second variation is effective in preventing erosion from occurring at such locations. However, since pressure at the piston retraction control port 113 is always low, the afore-described oil film shortage prevention effect and cavitation suppression effect at a piston large-diameter section (front) 201 are reduced.

Third Variation

Figure 6:
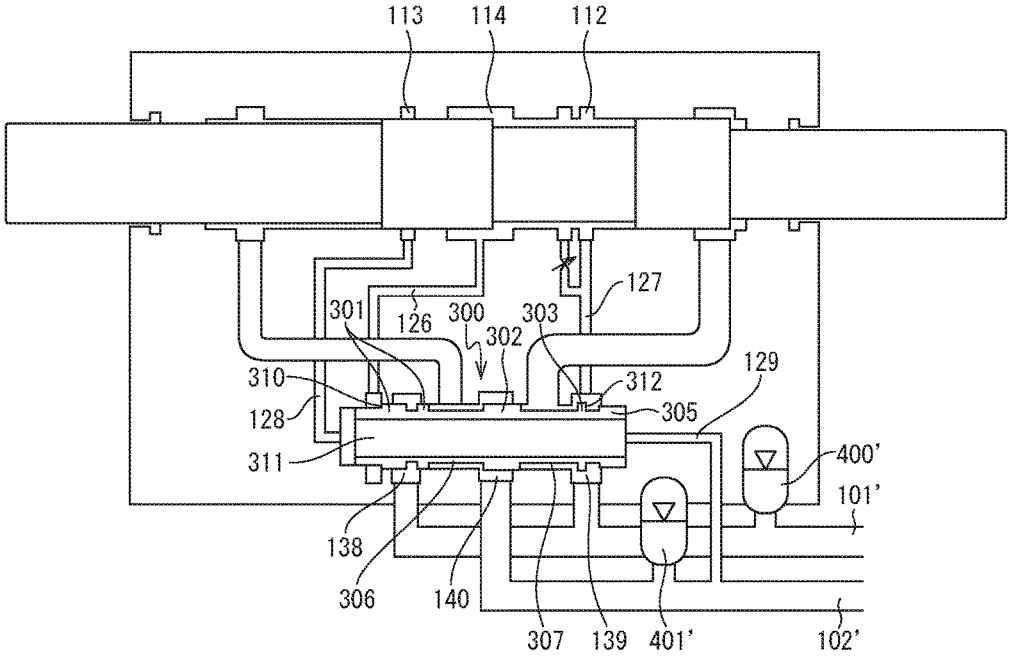
FIG. 6 is a schematic view of a hydraulic hammering device of a third variation of the first embodiment in which a high pressure circuit and a low pressure circuit are connected in a reverse manner.

A third variation of the above-described first embodiment is illustrated in FIG. 6. The third variation is a case in which, without changing any of respective hydraulic passages, respective ports, and a valve structure themselves, a high pressure line from a hydraulic source and a low pressure line running toward a tank are connected in a reverse manner (that is, a case in which the high pressure circuit 101 and the low pressure circuit 102 are defined to be a low pressure circuit 102' and a high pressure circuit 101', respectively).

In the following description of the third variation, since pressure in the valve high pressure passage (front) 123 and the valve high pressure passage (rear) 124 is low, the valve high pressure passage (front) 123 and the valve high pressure passage (rear) 124 are replaced with a valve low pressure passage (front) 128 and a valve low pressure passage (rear) 129, respectively. Since pressure in the valve low pressure passage 125 is high, the valve low pressure passage 125 is replaced with a valve high pressure passage 127. Similarly, since pressure at the piston high pressure port 134 is low, the piston high pressure port 134 is replaced with a piston low pressure port 140, and, since pressure at the piston front chamber low pressure port 135 and at the piston rear chamber low pressure port 136 is high, the piston front chamber low pressure port 135 and the piston rear chamber low pressure port 136 are replaced with a piston front chamber high pressure port 138 and a piston rear chamber high pressure port 139, respectively. It is assumed that an accumulator 400' is disposed to the high pressure circuit 101'.

In the third variation, as with the afore-described second variation, relations of movement between the piston and the valve are also reversed from those in the first embodiment illustrated in FIG. 1. Further, there is also a difference with respect to a valve drive mechanism by a switching valve mechanism. That is, to achieve a "valve pressing means", instead of thrust force in the advance direction caused by a difference between pressure receiving areas at both end faces of the valve as in the examples illustrated in FIGS. 1, 4, and 5, thrust force in the advance direction caused by pressurized oil being applied to a stepped face 312 is used.

In the third variation, pressure at a piston retraction control port 113, in a valve hollow passage 311, at a valve front end face 308, and at a valve rear end face 309 is always low. For this reason, oil film shortage prevention effect and cavitation suppression effect at a piston large-diameter section (front) 201 and cavitation suppression effect at both end faces of the valve are reduced. However, since pressure at a piston advance control port 112 is always high on the other hand, it can be expected to achieve a cavitation suppression effect at the location.

If one end of the valve high pressure passage 127 is connected to a location on the upper stream side than the high pressure accumulator 400', it is possible to prevent influence from water hammer occurring in pressurized oil when the piston hammers from reaching a valve control chamber 137.

Second Embodiment

Figure 7:
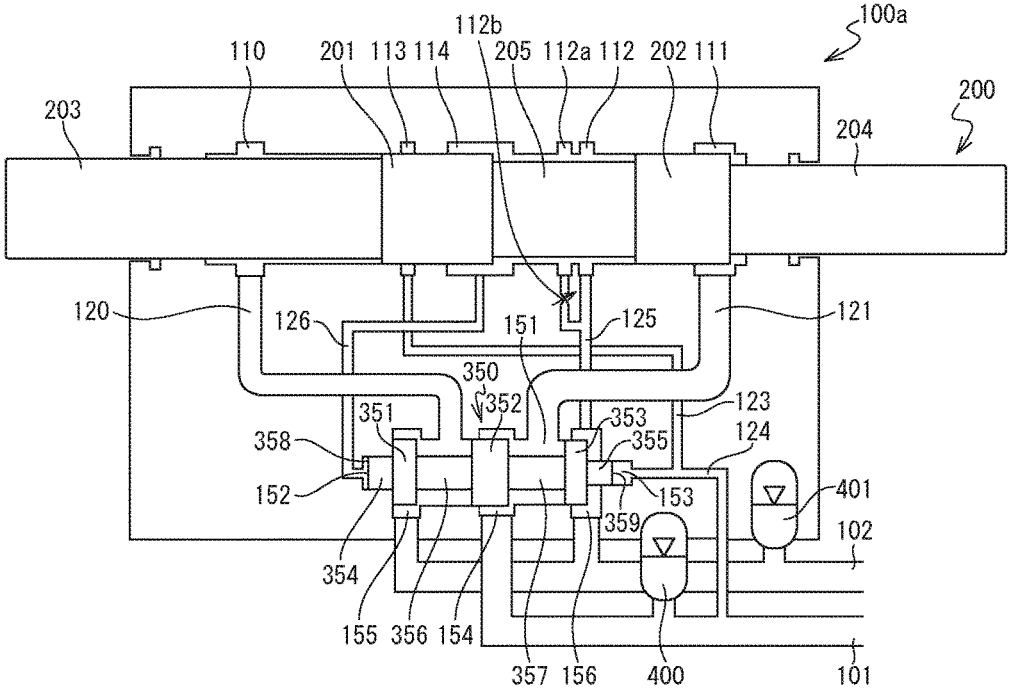
FIG. 7 is a schematic view of a second embodiment of the hydraulic hammering device of the piston front/rear chamber high/low pressure switching type according to the present invention.

Next, a second embodiment of the hydraulic hammering device of the piston front/rear chamber high/low pressure switching type according to the present invention will be described. FIG. 7 is a schematic view of the second embodiment. Although, in all of the above-described first embodiment and the variations thereof, examples in each of which a hollow valve is employed are described, the second embodiment is an example in which a solid valve is employed. Hereinafter, only different features from the first embodiment will be described.

As illustrated in FIG. 7, in a cylinder 100*a*, a valve chamber 150 is formed in a non-concentric manner with a piston 200, and a valve 350 is slidably fitted into the valve chamber 150. The valve chamber 150 has, in order from the front to the rear, a valve front chamber 152, a valve main chamber 151, and a valve rear chamber 153. In the valve main chamber 151, in order from the front to the rear, a piston front chamber low pressure port 155, a piston high pressure port 154, and a piston rear chamber low pressure port 156, are formed separated from each other at predetermined intervals.

The valve 350 is a solid valve body and has, on the outer peripheral surface, valve large-diameter sections 351, 352, and 353, a valve medium-diameter section 354 formed in front thereof, and a valve small-diameter section 355 formed in the rear thereof. Between the valve large-diameter section 351 and the valve large-diameter section 352, an annular piston front chamber switching groove 356 is formed. Between the valve large-diameter section 352 and the valve large-diameter section 353, an annular piston rear chamber switching groove 357 is formed. In the second embodiment, the piston front chamber switching groove 356 and the piston rear chamber switching groove 357 correspond to the "piston high/low pressure switching section", which is described in the summary section above.

The valve large-diameter sections 351, 352, and 353, the valve medium-diameter section 354, and the valve small-diameter section 355 are configured to be slidably fitted into the valve main chamber 151, the valve front chamber 152, and the valve rear chamber 153, respectively. The front end face and the rear end face of the valve 350 are a valve front end face 358 and a valve rear end face 359, respectively. In the above configuration, the outer diameter of the valve medium-diameter section 354 is set larger than that of the valve small-diameter section 355. Thus, the pressure receiving area of the valve front end face 358 is larger than that of the valve rear end face 359.

A high pressure circuit 101 is connected to the piston high pressure port 154, and a low pressure circuit 102 is connected to the piston front chamber low pressure port 155 and the piston rear chamber low pressure port 156. One end and the other end of a piston front chamber passage 120 are connected to a piston front chamber 110 and the intermediate section between the piston high pressure port 154 and the piston front chamber low pressure port 155 of the valve main chamber 151, respectively. One end and the other end of a piston rear chamber passage 121 are connected to a piston rear chamber 111 and the intermediate section between the piston high pressure port 154 and the piston rear chamber low pressure port 156 of the valve main chamber 151, respectively.

A valve high pressure passage (front) 123 connects a piston retraction control port 113 to a valve high pressure passage (rear) 124. The valve high pressure passage 124 connects the valve rear chamber 153 to a location on the upper stream side of the high pressure circuit 101 than a high pressure accumulator 400 (the right side in FIG. 7). Thus, pressure in the valve rear chamber 153 is always high, and pressurized oil being supplied to the pressure receiving area of the valve rear end face 359 causes advancing thrust force to be always applied to the valve 350. That is, in the second embodiment, the configuration in which pressure in the valve rear chamber 153 being always high and pressurized oil being supplied to the pressure receiving area of the valve rear end face 359 causes advancing thrust force to be always applied to the valve 350 corresponds to the "valve presser", which is described in the summary section above.

A valve low pressure passage 125 connects a piston advance control port 112 to the piston rear chamber low pressure port 156. A valve control passage 126 connects a valve control port 114 to the valve front chamber 152. The valve low pressure passage 125 may connect the piston advance control port 112 to the low pressure circuit 102.

When the valve control port 114 comes into communication with the piston retraction control port 113, high pressure oil from the valve high pressure passage (front) 123 is supplied to the valve front chamber 152 by way of the valve control passage 126. With this operation, the valve 350 retracts due to a difference in the pressure receiving areas between the valve front end face 358 and the valve rear end face 359. In the second embodiment, the configuration to make the valve 350 retract against the advancing thrust force (equivalent to the above-described always-applied pressing force by the "valve pressing means") applied to the valve 350 corresponds to the "valve controller", which is described in the summary section above. That is, the valve front chamber 152 of the embodiment is equivalent to the valve control chamber 137 of the above-described first embodiment.

In the second embodiment, a distinctive feature is that the valve has a solid structure. Since a solid valve has a higher rigidity than a hollow valve, differences in diameters between the large-diameter sections 351, 352, and 353 and the piston front chamber switching groove 356 and between the large-diameter sections 351, 352, and 353 and the piston rear chamber switching groove 357 can be set large, enabling the areas of passages in these portions to be enlarged. Therefore, the structure of the second embodiment is effective for a case in which a hammering device, even if having some deficiency in hydraulic efficiency, having a specification of high striking power based on ultrahighpressure and a large quantity of oil is required. Although there is a possibility that cavitation occurs at the ends of a stroke of the valve switching (the front end face of the large-diameter section 351 and the rear end face of the large-diameter section 353), the second embodiment otherwise produces basically the same operational effects as the first embodiment illustrated in FIG. 1.

Variation of Second Embodiment

Figure 8:
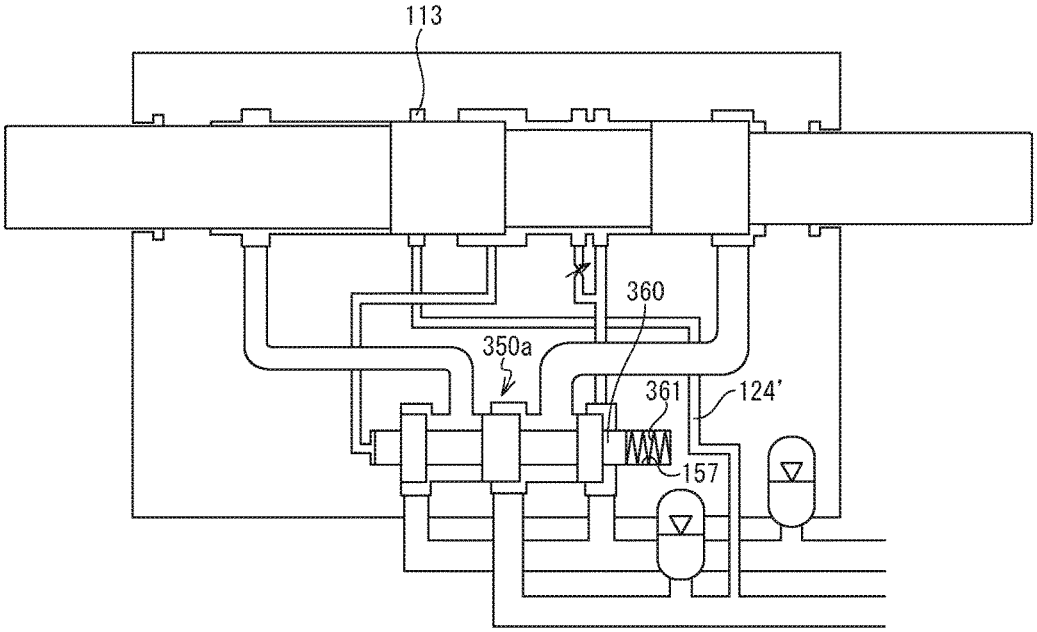
FIG. 8 is a schematic view of a hydraulic hammering device of a variation of the second embodiment the valve pressing means of which is a spring.

A variation of the above-described second embodiment is illustrated in FIG. 8. The variation is an example in which a "valve pressing means" is achieved by a mechanical configuration instead of a hydraulic mechanism. That is, as illustrated in FIG. 8, a valve 350*a* of the variation is provided with, in substitution for the small-diameter section 355 of the above-described valve 350, a small-diameter section 360 constituting the valve pressing means, and a spring 361 contained in a valve pressing chamber 157 pressing an end face of the small-diameter section 360 causes advancing thrust force to be always applied to the valve 350*a*.

In the variation, it is not required to supply pressurized oil to the valve pressing chamber 157. Thus, a valve high pressure passage (rear) 124' is configured to connect a valve retraction control port 113 to a high pressure circuit 101. The other configurations are the same as those of the second embodiment illustrated in FIG. 7.

When the configuration of the variation is employed, since the "valve pressing means" is achieved by a mechanical configuration instead of a hydraulic mechanism, one of hydraulic passages can be omitted. Thus, a processing cost of hydraulic passages can be suppressed. Although, in the variation, the spring 361 is employed as a pressing means constituting the "valve pressing means", without being limited to this configuration, another means (for example, the valve pressing chamber 157 is filled with high pressure gas) may be employed.

As described thus far, since the embodiments and the variations of the present invention employ the front/rear chamber high/low pressure switching method to drive a piston, a large number of strikes can be achieved. Furthermore, the embodiments and the variations of the present invention deal with a technology that, by employing a method to, while always pressing the valve in one direction, switch between advancing and retracting directions of valve movements depending on whether supplying or discharging control pressure as a valve drive mechanism in a switching valve mechanism, simplifies the overall configuration of hydraulic circuits in a hydraulic hammering device, enabling both targets to reduce a processing cost and to improve hammering efficiency to be achieved at the same time, and are a technology making a clear distinction from the above-described conventional hammering device.

Although the embodiments and variations of the present invention were described above with reference to the accompanying drawings, the hydraulic hammering device employing the piston front/rear chamber high/low pressure switching method according to the present invention is not limited to the above-described embodiments and variations, and it should be understood that other various modifications and alterations to the respective components can be made without departing from the spirit and scope of the present invention.

A list of the reference numbers in the drawings is described below.

100 Cylinder
100*a* Cylinder
101, 101' High pressure circuit
102, 102' Low pressure circuit
110 Piston front chamber
111 Piston rear chamber
112 Piston advance control port
112*a* Piston advance control port (short stroke)
113 Piston retraction control port
114 Valve control port
120 Piston front chamber passage
121 Piston rear chamber passage
123, 123', 123" Valve high pressure passage (front)
124, 124' Valve high pressure passage (rear)
125, 125' Valve low pressure passage
126, 126' Valve control passage
127 Valve high pressure passage
128 Valve low pressure passage (front)
129 Valve low pressure passage (rear)
130 Valve chamber
131 Valve chamber large-diameter section
132 Valve chamber small-diameter section
133 Valve chamber medium-diameter section
134 Piston high pressure port
135 Piston front chamber low pressure port
136 Piston rear chamber low pressure port
137 Valve control chamber
138 Piston front chamber high pressure port
139 Piston rear chamber high pressure port
140 Piston low pressure port
150 Valve chamber
151 Valve main chamber
152 Valve front chamber
153 Valve rear chamber
154 Piston high pressure port
155 Piston front chamber low pressure port
156 Piston rear chamber low pressure port
157 Valve pressing chamber
200 Piston
201 Large-diameter section (front)
202 Large-diameter section (rear)
203 Small-diameter section (front)
204 Small-diameter section (rear)
205 Valve switching groove
210 Switching valve mechanism
300 Valve (hollow)
300*a* Valve (hollow, internal passage)
300*b* Valve (hollow, reverse acting)
301, 301' Valve large-diameter section (front)
302, 302' Valve large-diameter section (middle)
303, 303' Valve large-diameter section (rear)
304, 304' Valve small-diameter section
305, 306' Valve medium-diameter section
306 Piston front chamber switching groove (piston high/low pressure switching section)
307 Piston rear chamber switching groove (piston high/low pressure switching section)
308, 308' Valve front end face
309, 309' Valve rear end face
310, 310' Valve stepped face (front)
311, 311' Valve hollow passage
312 Valve stepped face (rear)
313 Valve main body high pressure passage
314 Piston front chamber oil discharge groove
315 Piston rear chamber oil discharge groove

316 Piston front/rear chamber switching groove
350 Valve (solid)
350*a* Valve (solid, spring pressed)
351 Valve large-diameter section (front)
352 Valve large-diameter section (middle)
353 Valve large-diameter section (rear)
354 Valve medium-diameter section
355 Valve small-diameter section
356 Piston front chamber switching groove
357 Piston rear chamber switching groove
358 Valve front end face
359 Valve rear end face
360 Small-diameter section (valve pressing means)
361 Spring (valve pressing means)
400, 400' High pressure accumulator
401, 401' Low pressure accumulator

The invention claimed is:

1. A hydraulic hammering device comprising:

a cylinder;

a piston that is slidably fitted into the inside of the cylinder;

a piston front chamber and a piston rear chamber that are defined between an outer peripheral surface of the piston and an inner peripheral surface of the cylinder and are arranged separated from each other in axially front and rear direction; and a switching valve mechanism configured to switch each of the piston front chamber and the piston rear chamber into communication with either a high pressure circuit or a low pressure circuit in an interchanging manner; and which is configured to hammer a rod to be hammered, by making the piston advance and retract in the cylinder, wherein the piston has a large-diameter section, small-diameter sections that are individually disposed in front and the rear of the large-diameter section, and a valve switching groove that is formed substantially at an axially middle portion of the large-diameter section, the switching valve mechanism has a valve chamber that is formed in the cylinder in a non-concentric manner with the piston, a valve that is slidably fitted into the valve chamber and has a piston high/low pressure switching section formed that is configured to, by the valve advancing or retracting, switch each of the piston front chamber and the piston rear chamber into communication with either the high pressure circuit or the low pressure circuit in an interchanging manner, a valve presser configured to always press the valve in either of advancing and retracting directions, and a valve controller configured to, when pressurized oil is supplied, move the valve to an opposite direction against pressing force by the valve presser, the cylinder has three control ports including, in order from the front, a piston retraction control port, a valve control port, and a piston advance control port, between the piston front chamber and the piston rear chamber, the valve control port is in communication with the valve controller in such a way as to be able to supply and discharge the pressurized oil and is always isolated from respective ones of the piston front chamber and the piston rear chamber, and the piston retraction control port and the piston advance control port, by only either one of the piston retraction control port and the piston advance control port communicating with the valve control port depending on an advancing or a retracting movement of the valve switching groove in association with an advance or a retraction of the piston, supply and discharge the pressurized oil to and from the valve controller to make the valve advance and retract, and the switching valve mechanism switches each of the piston front chamber and the piston rear chamber into communication with either the high pressure circuit or the low pressure circuit in an interchanging manner depending on an advancing or a retracting movement of the piston high/low pressure switching section in association with an advance or a retraction of the valve to supply and discharge hydraulic oil so that an advance and a retraction of the piston can be repeated.

2. A hydraulic hammering device comprising:

a cylinder;

a piston that is slidably fitted into the inside of the cylinder;

a piston front chamber and a piston rear chamber that are defined between an outer peripheral surface of the piston and an inner peripheral surface of the cylinder and are arranged separated from each other in axially front and rear direction; and a switching valve mechanism configured to switch each of the piston front chamber and the piston rear chamber into communication with either a high pressure circuit or a low pressure circuit in an interchanging manner; and which is configured to hammer a rod to be hammered, by making the piston advance and retract in the cylinder, wherein the piston has a large-diameter section, small-diameter sections that are individually disposed in front and the rear of the large-diameter section, and a valve switching groove that is formed substantially at an axially middle portion of the large-diameter section, the switching valve mechanism has a valve chamber that is formed in the cylinder in a non-concentric manner with the piston, a valve that is slidably fitted into the valve chamber and has a piston high/low pressure switching section formed that is configured to, by the valve advancing or retracting, switch each of the piston front chamber and the piston rear chamber into communication with either the high pressure circuit or the low pressure circuit in an interchanging manner, a valve presser that always presses the valve in either of advancing and retracting directions, and a valve controller configured to, when pressurized oil is supplied, move the valve to an opposite direction against pressing force by the valve presser, the cylinder has three control ports including, in order from the front, a piston retraction control port, a valve control port, and a piston advance control port, between the piston front chamber and the piston rear chamber, the valve control port is in communication with the valve controller in such a way as to be able to supply and discharge the pressurized oil and is always isolated from respective ones of the piston front chamber and the piston rear chamber, and the piston retraction control port and the piston advance control port are configured to cause, in association with an advance of the piston, the valve switching groove to communicate with the piston retraction control port and the valve control port and the pressurized oil to be supplied to the valve controller to make the valve retract and, in association with a retraction of the piston, the valve switching groove to communicate with the piston advance control port and the valve control port and the pressurized oil to be discharged from the valve controller to make the valve advance, and the switching valve mechanism switches each of the piston front chamber and the piston rear chamber into communication with either the high pressure circuit or the low pressure circuit in an interchanging manner depending on an advancing or a retracting movement of the piston high/low pressure switching section in association with an advance or a retraction of the valve to supply and discharge hydraulic oil so that an advance and a retraction of the piston can be repeated.

3. The hydraulic hammering device according to claim 2, wherein:

the piston retraction control port is always connected under high pressure.

4. The hydraulic hammering device according to claim 3, wherein:

the valve has a hollow structure that has an axially penetrating valve hollow passage.

5. The hydraulic hammering device according to claim 4, wherein:

the piston retraction control port is always connected under high pressure.

6. The hydraulic hammering device according to claim 3, wherein:

the piston advance control port includes a short stroke port and a long stroke port that are disposed separated from each other in the front and the rear direction, and a variable choke that is variable from full close to full open is disposed between the short stroke port and the valve low pressure passage.

7. The hydraulic hammering device according to claim 2, wherein:

an accumulator is disposed between a path to supply the pressurized oil to the valve presser and the valve controller and a path to supply the pressurized oil to the piston rear chamber.

8. The hydraulic hammering device according to claim 7, wherein:

the valve has a hollow structure that has an axially penetrating valve hollow passage.

9. The hydraulic hammering device according to claim 8, wherein:

the piston retraction control port is always connected under high pressure.

10. The hydraulic hammering device according to claim 2, wherein:

the valve has a hollow structure that has an axially penetrating valve hollow passage.

11. The hydraulic hammering device according to claim 10, wherein:

the piston retraction control port is always connected under high pressure.

12. The hydraulic hammering device according to claim 1, wherein:

the piston retraction control port is always connected under high pressure.

13. The hydraulic hammering device according to claim 12, wherein:

the valve has a hollow structure that has an axially penetrating valve hollow passage.

14. The hydraulic hammering device according to claim 13, wherein:

the piston retraction control port is always connected under high pressure.

15. The hydraulic hammering device according to claim 12, wherein:

the piston advance control port includes a short stroke port and a long stroke port that are disposed separated from each other in the front and the rear direction, and a variable choke that is variable from full close to full open is disposed between the short stroke port and the valve low pressure passage.

16. The hydraulic hammering device according to claim 1, wherein:

an accumulator is disposed between a path to supply the pressurized oil to the valve presser and the valve controller and a path to supply the pressurized oil to the piston rear chamber.

17. The hydraulic hammering device according to claim 16, wherein:

the valve has a hollow structure that has an axially penetrating valve hollow passage.

18. The hydraulic hammering device according to claim 17, wherein:

the piston retraction control port is always connected under high pressure.

19. The hydraulic hammering device according to claim 1, wherein:

the valve has a hollow structure that has an axially penetrating valve hollow passage.

20. The hydraulic hammering device according to claim 19, wherein:

the piston retraction control port is always connected under high pressure.

* * * * *